US009424801B2

(12) United States Patent
Horikawa et al.

(10) Patent No.: US 9,424,801 B2
(45) Date of Patent: Aug. 23, 2016

(54) DISPLAY CONTROL DEVICE, NON-TRANSITORY COMPUTER READABLE MEDIUM STORING DISPLAY CONTROL PROGRAM, AND COLOR VALUE DATA STRUCTURE

(71) Applicant: FUJI XEROX CO., LTD., Tokyo (JP)

(72) Inventors: Kazuhiko Horikawa, Kanagawa (JP); Noriko Sakai, Kanagawa (JP); Toshihiro Iwafuchi, Kanagawa (JP); Daigo Hama, Kanagawa (JP); Makoto Fujio, Kanagawa (JP); Chizuru Yamazaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 61 days.

(21) Appl. No.: 14/478,559

(22) Filed: Sep. 5, 2014

(65) Prior Publication Data

US 2015/0199938 A1 Jul. 16, 2015

(30) Foreign Application Priority Data

Jan. 16, 2014 (JP) ..... 2014-006269

(51) Int. Cl.
*G09G 5/10* (2006.01)
*G09G 5/02* (2006.01)

(52) U.S. Cl.
CPC ..... *G09G 5/02* (2013.01); *G09G 2320/0666* (2013.01); *G09G 2340/06* (2013.01)

(58) Field of Classification Search
CPC ..... G09G 5/10; G09G 1/06; G09G 3/28; G09G 3/30; G09G 3/36; G09G 5/00
See application file for complete search history.

(56) References Cited

U.S. PATENT DOCUMENTS

| | | | | |
|---|---|---|---|---|
| 5,930,388 | A | 7/1999 | Murakami et al. | |
| 8,610,739 | B2 * | 12/2013 | Lonkar | G06F 3/1431 345/2.1 |
| 2006/0158671 | A1 * | 7/2006 | Cho | H04N 1/628 358/1.9 |
| 2010/0103200 | A1 * | 4/2010 | Langendijk | G09G 5/02 345/690 |
| 2013/0207995 | A1 * | 8/2013 | Yoshida | G06F 3/1454 345/600 |

FOREIGN PATENT DOCUMENTS

| | | |
|---|---|---|
| JP | A-8-195890 | 7/1996 |
| JP | A-10-136216 | 5/1998 |
| JP | A-2005-91005 | 4/2005 |
| JP | A-2006-203896 | 8/2006 |

(Continued)

OTHER PUBLICATIONS

Translation of Office Action issued in Japanese Application No. 2014-006269 mailed Jul. 2, 2014.

(Continued)

*Primary Examiner* — Pegeman Karimi
(74) *Attorney, Agent, or Firm* — Oliff PLC

(57) ABSTRACT

Provided is a display control device causing a display unit to display plural color charts constituting a color sample used when obtaining color reproduction characteristics of the display unit, which densely include a color in which all values of two color components are set to be a minimum value or a maximum value of the values of the respective color components, in colors in which a value of one color component out of plural color components in a color space of the display unit is set to be a minimum value or a maximum value of the value of the color component.

7 Claims, 8 Drawing Sheets

(56) References Cited

FOREIGN PATENT DOCUMENTS

| | | |
|---|---|---|
| JP | A-2008-153992 | 7/2008 |
| JP | A-2009-071715 | 4/2009 |
| JP | A-2009-225479 | 10/2009 |
| JP | A-2011-211392 | 10/2011 |

OTHER PUBLICATIONS

Office Action issued in Japanese Patent Application No. 2014-006269 dated Oct. 1, 2014 (with translation).

* cited by examiner

DISPLAY CONTROL DEVICE, NON-TRANSITORY COMPUTER READABLE MEDIUM STORING DISPLAY CONTROL PROGRAM, AND COLOR VALUE DATA STRUCTURE

CROSS-REFERENCE TO RELATED APPLICATIONS

This application is based on and claims priority under 35 USC 119 from Japanese Patent Application No. 2014-006269 filed Jan. 16, 2014.

BACKGROUND (i) Technical Field

The present invention relates to a display control device, a non-transitory computer readable medium storing a display control program, and a color value data structure.

(ii) Related Art

Generally, in output devices that output colors, even when values of certain colors are given, colors reproduced may be different from each other, and color ranges (color gamut) which are reproduced may be different from each other in the respective output devices. When it is considered that colors reproduced in different output devices are used in common, characteristics of colors reproduced in the respective devices are acquired, and the colors are converted so that the reproduced colors are used in common. Further, for example, when values of colors which are not reproduced in the device are given, color gamut compression processing of converting the colors into colors which are reproduced, and the like are also performed. Additionally, various pieces of color processing corresponding to color reproduction characteristics of the device are performed.

In order to perform these pieces of color processing or to obtain color reproduction characteristics, the values of colors are given to the output device, and it may be examined which colors are output from the output device. The colors output from the output device are generally measured using a color measurer to obtain color measurement values. Pairs (color value pair) of the color measurement values and the values of the colors which are given to the output device represent input-output characteristics of the output device in the given colors. When such color value pairs are evenly obtained in a color space, color reproduction characteristics of the output device are obtained.

In an image forming apparatus which is one of output devices, outputs of colors are collectively performed, and the color measurements thereof are collectively performed. However, in a display device and the like, an operation of performing a color measurement by giving values of colors one by one and displaying the colors has to be repeated by the number of color value pairs to be acquired. Accordingly, when time and effort are considered, the number of color value pairs is limited in the display device and the like, as compared with an image forming apparatus.

When the above-described color conversion is performed, a color conversion model representing color conversion characteristics is created, and the color conversion is performed using the color conversion model. In addition, when color gamut compression processing is performed, color gamut contours which are boundaries of the color gamut are obtained, and color conversion is performed using the color gamut contours. The creation of the color conversion model and the acquisition of the color gamut contours are performed using the above-described color value pair.

The color value pairs used affect the accuracy of the color conversion model and the color gamut contours which are created from the color value pairs. When color value pairs are evenly acquired and are used in a color space, a color conversion model and color gamut contours which correspond to color reproduction characteristics of an output device are obtained. However, when the number of color value pairs is limited, it becomes necessary to devise colors to be used when acquiring the color value pairs and to suppress the influence on the accuracy thereof.

SUMMARY

According to an aspect of the invention, there is provided, a display control device causing a display unit to display plural color charts constituting a color sample used when obtaining color reproduction characteristics of the display unit, which densely include a color in which all values of two color components are set to be a minimum value or a maximum value of the values of the respective color components, in colors in which a value of one color component out of plural color components in a color space of the display unit is set to be a minimum value or a maximum value of the value of the color component.

BRIEF DESCRIPTION OF THE DRAWINGS

Exemplary embodiments of the present invention will be described in detail based on the following figures, wherein.

DETAILED DESCRIPTION

Figure 1:
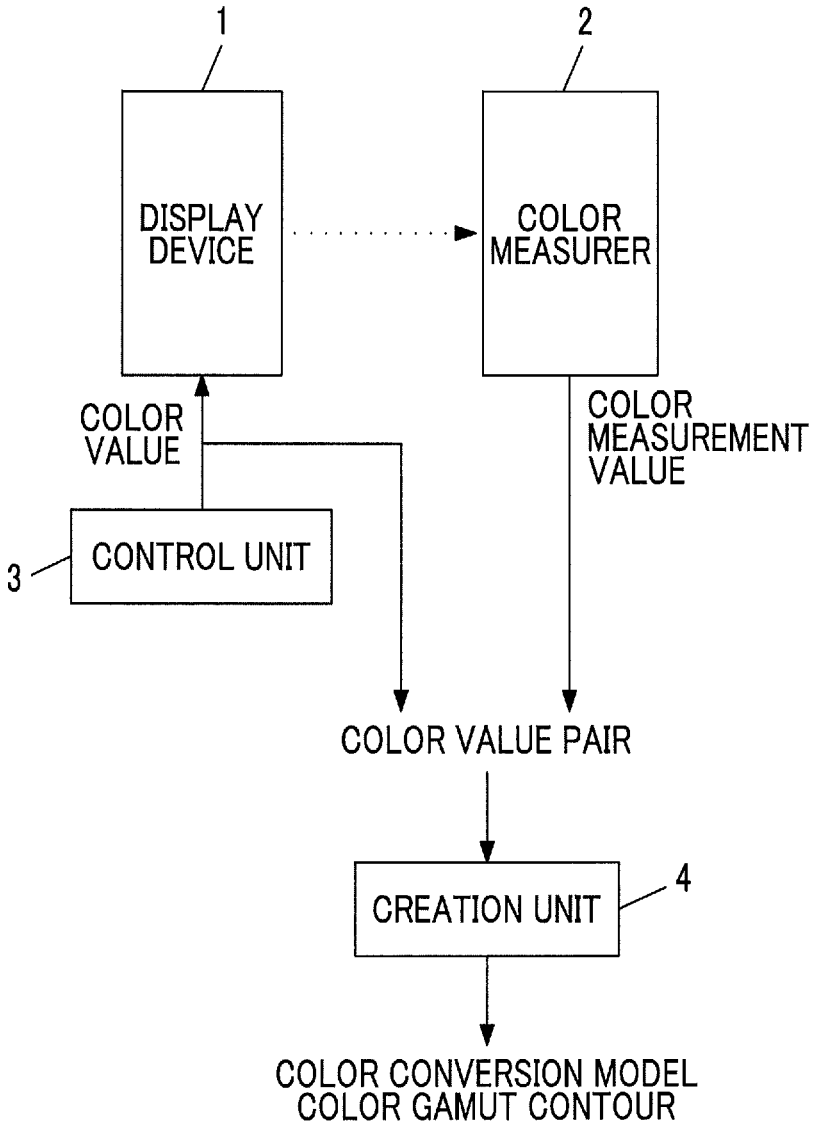
FIG. 1 is a configuration diagram including a first exemplary embodiment of the invention.

FIG. 1 is a configuration diagram including a first exemplary embodiment of the invention. In FIG. 1, 1 denotes a display device, 2 denotes a color measurer, 3 denotes a control unit, and 4 denotes a creation unit. An example shown in FIG. 1 shows not only a display control when acquiring color reproduction characteristics of the display device 1 but also a configuration in which color value pairs are acquired and used.

The display device 1 displays a color image. When color value pairs corresponding to the color reproduction characteristics of the display device 1 are acquired, colors are displayed in response to values of colors given from the control unit 3. As the display device 1, a projection type display device, such as a projector, and the like may be used, in addition to a CRT, a liquid crystal display device, a plasma display device, an organic EL display device, and the like.

The color measurer 2 measures colors displayed on the display device 1 under the control of the control unit 3, and obtains color measurement values. The color measurer 2 may be a known color measurer. Meanwhile, in addition to using values of a color space output from the color measurer 2 as the color measurement values, the color measurement values may be converted into values of a color space that is not dependent on other devices.

The control unit 3 controls a display on the display device 1. When color reproduction characteristics of the display device 1 are acquired, a control is performed of giving values of colors of plural color charts constituting a color sample to the display device 1 to display the colors. Further, plural pairs (color value pairs) of the values of the colors which are given to the display device 1 and the color measurement values obtained by measuring the colors, displayed on the display device 1, using the color measurer 2 are obtained to acquire the color reproduction characteristics. Accordingly, when the color reproduction characteristics are acquired, the acquisition is repeatedly performed while changing the colors displayed as the color charts constituting the color sample on the display device 1. An example of the colors of the color charts, constituting the color sample, which are displayed on the display device 1 by the control unit 3 will be described later in detail.

The creation unit 4 acquires color reproduction characteristics of the display device 1 and creates, for example, a color conversion model representing color reproduction characteristics of the display device 1. Alternatively, the creation unit creates contours of a region (color gamut) of colors displayed on the display device 1. Alternatively, the creation unit further creates a color conversion profile of the display device 1 based on pieces of information of the color conversion model and the color gamut contours. Naturally, various processes using color value pairs may also be performed. When the color reproduction characteristics of the display device 1 are acquired, the control unit 3 obtains values of colors which are given to the display device 1 and obtains color measurement values by controlling the color measurer 2 to measure colors displayed on the display device 1. The control unit 3 associates the values of the colors which are given to the display device 1 with the color measurement values obtained from the color measurer 2 to acquire color value pairs. Plural color value pairs may be acquired by repeatedly performing such a process whenever the control unit 3 changes the colors given to the display device 1. The plural color value pairs represent color reproduction characteristics of the display device 1 and may be used to create the color conversion model, the color gamut contour, the color conversion profile, and the like which are described above.

As described above, repetitive processes and operations are performed when acquiring the color value pairs corresponding to the color reproduction characteristics of the display device 1, which requires time and effort. For this reason, unlike obtaining the color value pairs collectively by, for example, an image forming apparatus, the number of color value pairs is limited. Even when the number of color value pairs is limited in that manner, the degrees of accuracy of the color conversion model, the color gamut contours, and the like which are created by the creation unit 4 are secured. Hereinafter, some concrete examples of colors displayed on the display device 1 and color value pairs acquired in the first exemplary embodiment are shown.

Figure 2A:
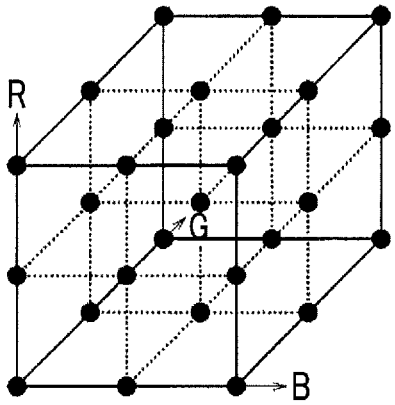
FIGS. 2A to 2D are diagrams illustrating a first concrete example of colors of a color sample displayed on a display device in the first exemplary embodiment of the invention.
Figure 2C:
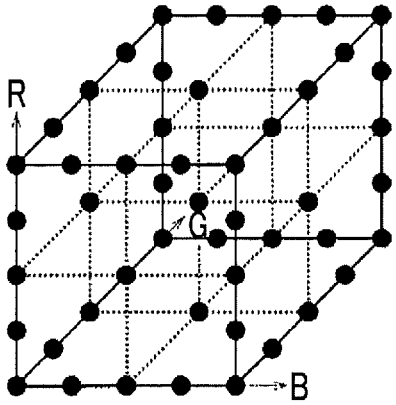
Figure 2B:
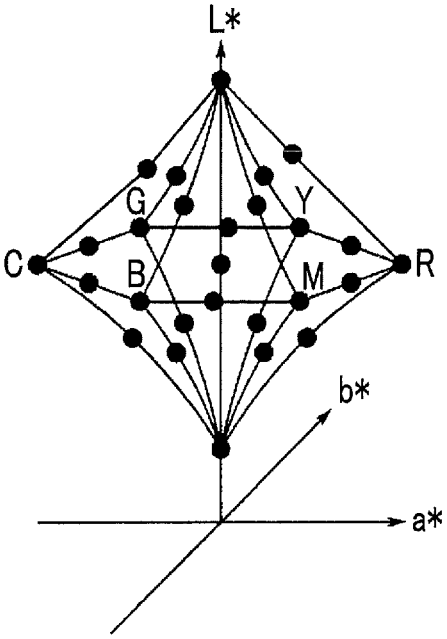
Figure 2D:
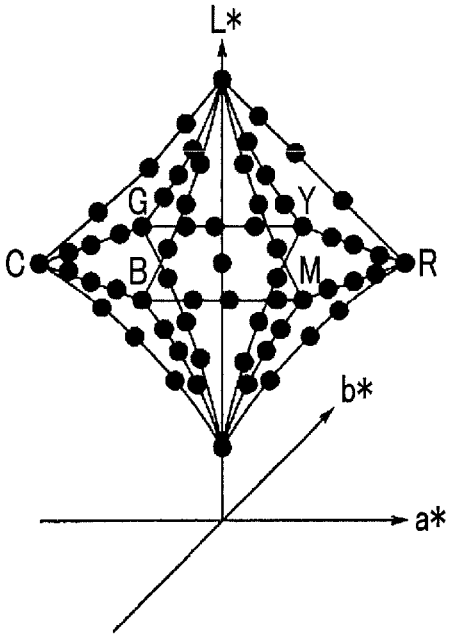

FIGS. 2A and 2D are diagrams illustrating a first concrete example of colors of a color sample displayed on the display device in the first exemplary embodiment of the invention. In the first concrete example, an example is shown of causing the display device 1 to display colors of plural color charts densely including a color in which all the values of two color components are set to be a minimum value or a maximum value of the values of the respective color components, in colors in which a value of one color component, out of plural color components indicating values of colors, is set to be a minimum value or a maximum value of the value of the color component, as colors of plural color charts constituting a color sample used when obtaining the color reproduction characteristics of the display device 1.

In this concrete example, as an example, it is assumed that the display device 1 receives values of colors of an RGB color space and displays the colors, that the color measurer 2 measures the displayed colors, and that values of a LAB color space are obtained as color measurement values. Color spaces of the values output from the color measurer 2 and the values acquired as the color measurement values may be different from each other. In this case, a color conversion may be performed. FIG. 2A shows an example of an RGB color space, and black circles indicate colors displayed on the display device 1. Each of color components R, G, and B is divided into two parts, and it is assumed that a combination of three of a minimum value, a maximum value, and an intermediate value is set to be values of colors to be displayed. Naturally, the number of divisions is not limited thereto. However, when the number of divisions increases, the number of colors increases in proportional to the cube thereof. Accordingly, the number of divisions is limited by time, effort, and the like for acquiring color value pairs.

A region (color gamut) of colors capable of being taken in the RGB color space is expressed as a hexahedron. In general, a maximum value and a minimum value are determined in values of color components received in the display device 1, and all of the R component, the G component, and the B component receive values of equal to or greater than the minimum value and equal to or less than the maximum value. Since the values of the color components are independent, the color gamut in the RGB color space of the display device 1 becomes a hexahedron shown in FIG. 2A and the like.

In this color gamut, the control unit 3 gives the RGB values of the colors indicated by the black circles to the display device 1 and causes the display device 1 to display the colors. The colors displayed on the display device 1 are measured by the color measurer 2 to obtain color measurement values. Color measurement values corresponding to the colors indicated by the black circles which are present in the color gamut in the RGB color space shown in FIG. 2A is indicated by black circles in a LAB color space shown in FIG. 2B. In FIG. 2B, color gamut contours obtained from the colors indicated by the black circles are shown by solid lines.

The color gamut in the RGB color space is a hexahedron, but the color gamut in the LAB color space of the color measurement values is a region surrounded by six curved surfaces. The sides of the hexahedron of the RGB color space are nodal lines of the adjacent curved surfaces in the LAB color space. Here, the nodal lines will be referred to as ridge lines. The colors of the ridge lines are important colors in the colors of the color gamut contours, and are colors having a great influence of an error as compared with colors of other color gamut contours, from the shapes of the color gamut contours in the LAB color space.

The ridge lines in the LAB color space may bend. When the number of divisions is limited, the ridge lines obtained from the color value pairs are polygonal lines, and thus have an error with the ridge lines constituted by a curved line. When the error in the ridge line is suppressed, the degrees of accuracy of the color gamut contours and the color conversion model, which are created by the creation unit 4, are secured.

In order to suppress the error, the number of divisions described in FIG. 2A is increased, and thus the curved surfaces are approximated in more planes and the ridge lines are also approximated in more straight lines. However, when the number of divisions is increased, the number of colors increases in proportional to the cube thereof. Although described above, an operation of performing a color measurement using the color measurer 2 by giving values of colors one by one to the display device 1 has to be repeated by the number of color value pairs to be acquired. When the display device 1 is a projector or the like, it takes time to perform a color measurement in the dark. Some colors may be projected and collectively measured using the color measurer 2 such as a camera. However, a device of collectively measuring colors is expensive as compared with a device of measuring colors one by one, and may have a disadvantage in the degree of accuracy thereof due to the influence of in-plane unevenness. Accordingly, when the number of color value pairs is limited, the number of divisions is also limited. In addition, even when color value pairs are simply added, the number of color value pairs is limited.

In this first concrete example, the colors of the ridge lines are densely included as colors of color charts constituting a color sample displayed on the display device 1, rather than colors present in other color gamut contours. Although described above, the colors of the ridge lines are important colors in the colors of the color gamut contours, and are colors having a great influence of an error, as compared with the colors of other contours, from the shapes of the color gamut contours in the LAB color space. Accordingly, when the creation unit 4 creates the color gamut contours, the number of color value pairs present in the ridge lines affects the degree of accuracy. In addition, even when the creation unit 4 creates a color conversion model and a color conversion profile, the color gamut contours are used in a case where colors outside the color gamut are converted to colors to be reproduced, and thus the degree of accuracy of the ridge lines is suitably affected. Therefore, when colors of the color sample are configured such that the colors of the color sample which are present in the ridge lines are densely included rather than colors of other contours, the degree of accuracy is secured even in a state where the number of color value pairs is restricted, for example, as compared with a case where the number of divisions of the values of the color components is increased.

In the RGB color space, the color gamut contours are surfaces of the hexahedron shown in FIG. 2A, and ridge lines are colors of sides of the hexahedron which constitute the contours. The colors are selected so as to densely include the colors of the sides rather than the colors of other contours, as colors of a color sample which are present in the ridge lines. Here, the colors of the sides of the hexahedron are colors in which all the values of two color components out of the color components of R, G, and B are set to be a minimum value or a maximum value of the values of the respective color components. For example, when each of the color components has a value of equal to or greater than 0 and equal to or less than 255, all of R and G, G and B, and R and B are colors having a value of 0 or 255. When both R and G are 0, a single color of B is set. When both G and B are 0, a single color of R is set. When both R and B are 0, a single color of G is set. In addition, when both R and G are 255, a single color of Y (yellow) is set. When both G and B are 255, a single color of C (cyan) is set. When both R and B are 255, a single color of M (magenta) is set.

The colors are selected so as to densely include the colors of the ridge lines of R, G, B, C, M, and Y rather than the colors of other contours. An example of the colors selected in this manner is shown in FIGS. 2C and 2D. In the RGB color space, colors indicated by black circles are added to the sides of a hexahedron in the example shown in FIG. 2C, as compared with the case of FIG. 2A. The control unit 3 causes the display device 1 to display the colors indicated by the black circles, a color gamut based on color measurement values obtained by performing a color measurement using the color measurer 2 is schematically shown in FIG. 2D. As compared with the cases shown in FIGS. 2A and 2B, the shapes of the ridge lines obtained from the color measurement values approach curved lines, and thus an error is prevented from occurring.

The creation unit 4 may acquire color value pairs by making pairs of the color measurement values obtained in this manner and values of colors which are given to the display device 1 by the control unit 3 at the time of the color measurement, and may create a color conversion model, a color gamut contour, a color conversion profile, and the like. For example, since the color value pairs of the ridge lines are added to the created color gamut contours of the display device 1, an error in the ridge line is prevented from occurring, and furthermore, the entirety of error is prevented from occurring. In addition, for example, when the color conversion model is created, the color reproducibility of R, G, B, C, M, Y, and the like is improved, and an error in which the converted colors are converted to colors which are not reproduced is prevented from occurring. Naturally, even when the color conversion profile of the display device 1 is created, an error is prevented from occurring.

Figure 3A:
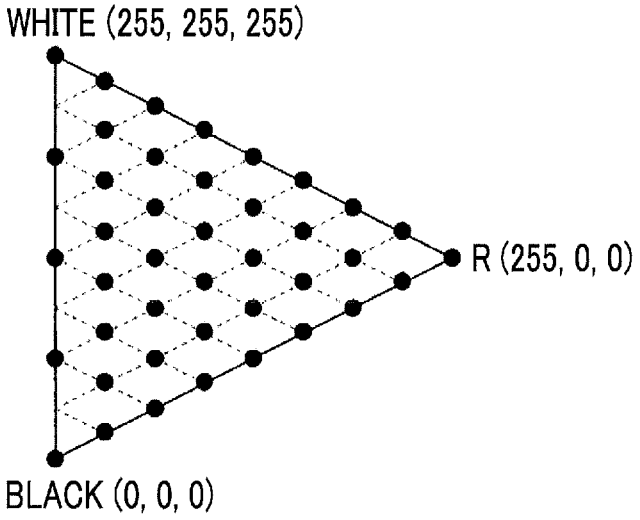
FIGS. 3A and 3B are diagrams illustrating a second concrete example of colors of a color sample displayed on a display device in the first exemplary embodiment of the invention.
Figure 3B:
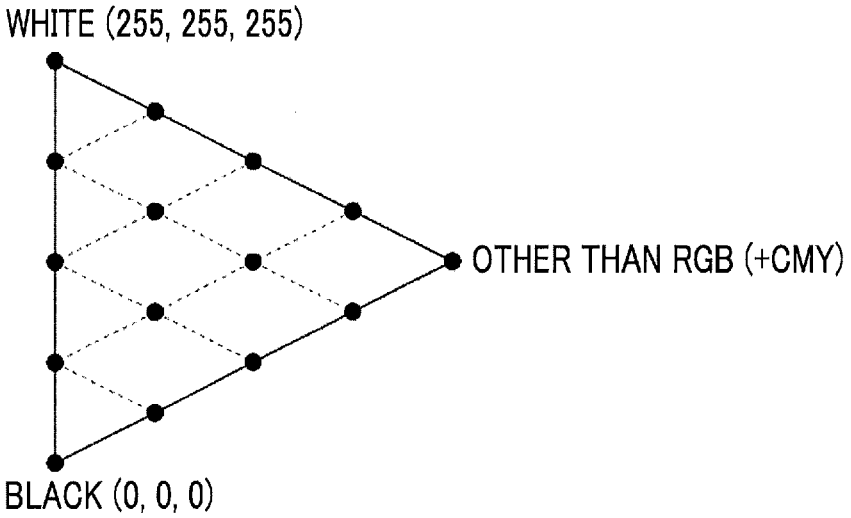
Figure 4:
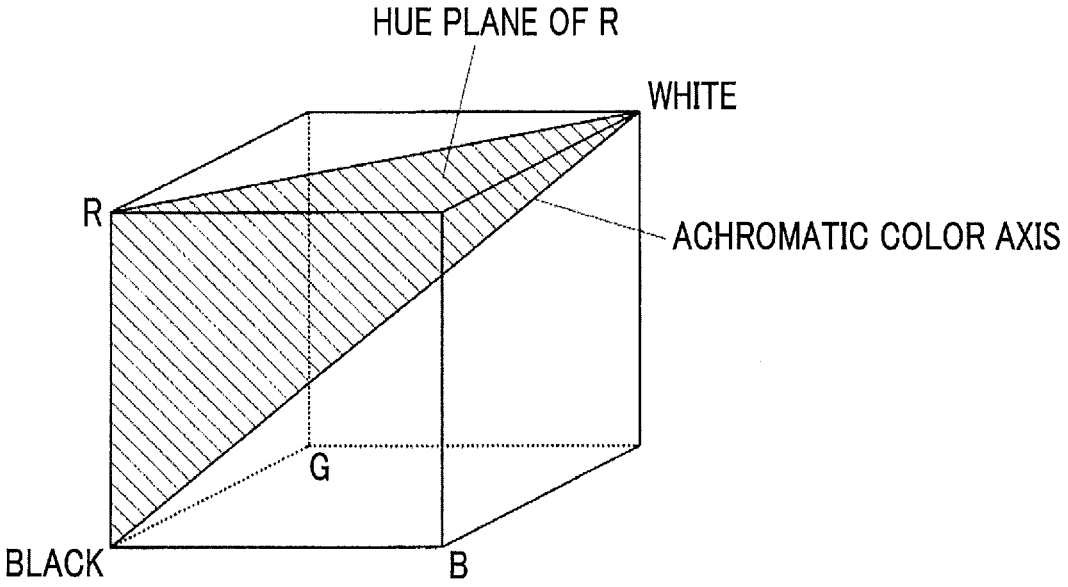
FIG. 4 is a diagram illustrating an example of a hue plane in an RGB color space.

FIGS. 3A and 3B are diagrams illustrating a second concrete example of colors of a color sample displayed on the display device in the first exemplary embodiment of the invention. FIG. 4 is a diagram illustrating an example of a hue plane in an RGB color space. In the second concrete example, an example is shown in which a color sample is constituted by colors of color charts displayed on the display device 1 so as to densely include colors included in a hue in which a value of one color component out of plural color components is set to be a maximum value and values of other color components are set to be a minimum value or a hue in which values of two color components are set to be a maximum value and values of other color components are set to be a minimum value, rather than colors included in other hues. Also in the concrete example, it is assumed that the display device 1 receives values of colors of the RGB color space and displays the colors, that the displayed colors are measured by the color measurer 2, and that values of a LAB color space are obtained as color measurement values.

The display device 1 generally expresses colors by additive color mixture. From this, when the degree of accuracy is secured in a hue in which a value of one color component serving as a basic color of a display is set to be a maximum value and values of other color components are set to be a minimum value, the degree of accuracy of the entire color gamut is obtained. For example, in the RGB color space, when color value pairs in hues of R, G, and B are densely acquired rather than in other hues, the degree of accuracy of the entire color gamut which is a color mixture is obtained. For example, when each color component has a value of equal to or greater than 0 and equal to or less than 255, color value pairs may be acquired by causing the display device 1 to display colors of plural color charts densely including colors in a hue including colors of (R, G, B)=(255, 0, 0), a hue including colors of (R, G, B)=(0, 255, 0), and a hue including colors of (R, G, B)=(0, 0, 255), rather than colors included in other hues.

As an example of the hue plane in the RGB color space, an example of the hue plane of R is shown in FIG. 4. An achromatic color axis is a straight line connecting a black color serving as the origin, that is, colors of (R, G, B)=(0, 0, 0) and a white color, that is, colors of (R, G, B)=(255, 255, 255). A plane including the straight line as one side and including an R color, that is, colors of (R, G, B)=(255, 0, 0) serves as the hue plane of R. In the case of a hue plane of G, a plane including the achromatic color axis and colors of (R, G, B)=(0, 255, 0) serves as the hue plane of G. In the case of a hue plane of B, a plane including the achromatic color axis and colors of (R, G, B)=(0, 0, 255) serves as the hue plane of B.

Further, also in a hue in which values of two color components are a maximum value and values of other color components are a minimum value, the degree of accuracy may be secured. For example, in addition to R, G, and B, also in hues of C, M, and Y, color value pairs may be densely acquired rather than in other hues. For example, when each color component has a value of equal to or greater than 0 and equal to or less than 255, color value pairs may be acquired by causing the display device 1 to display plural color charts densely including colors in a hue of C including colors of (R, G, B)=(0, 255, 255), a hue of M including colors of (R, G, B)=(255, 0, 255), and a hue of Y including colors of (R, G, B)=(255, 255, 0) together with the above-described hues of R, G, and B, rather than colors included in other hues.

FIG. 3A shows an example of color value pairs in a hue of R as an example. In addition, FIG. 3B shows an example of colors of color charts constituting a color sample displayed on the display device 1 in hues other than hues of R, G, and B or other than hues of C, M, and Y in addition to R, G, and B. In the drawings, colors indicated by black circles are colors of color charts constituting a color sample displayed on the display device 1. The number of colors of color charts displayed on the display device 1 in the hue of R shown in FIG. 3A is set to be greater than that in other hues shown in FIG. 3B.

Values of colors of plural color charts densely including colors included in the hues of R, G, and B or the hues of C, M, and Y, rather than colors included in other hues, are given to the display device 1, colors displayed on the display device are measured by the color measurer 2 to obtain color measurement values, and the creation unit 4 acquires color value pairs. For example, when the creation unit 4 creates a color conversion model of the display device 1 using the acquired color value pairs, the color reproducibility in the hues of R, G, and B or the hues of C, M, Y, and the like is improved. Here, R, G, B, C, M, and Y are colors serving as the vertex in both an RGB color space and a LAB color space. When an error at the time of a color conversion in the hue including the color serving as the vertex is prevented from occurring, an error at the time of a color conversion in the entire color gamut is prevented from occurring. In addition, for example, even when color gamut contours are created, an error in the ridge line described in the first concrete example is prevented from occurring, and furthermore, an error in all the color gamut contours is also prevented from occurring. Naturally, also in a case where a color conversion profile of the display device 1 is created, an error is prevented from occurring.

Meanwhile, a minimum value and a maximum value of color components in the RGB color space are not limited to the above-described concrete example. In the above-described concrete examples, it is assumed that values of colors received in the display device 1 are values of the RGB color space and that color measurement values of the LAB color space are obtained by performing a color measurement by the color measurer 2. However, it is needless to say that any of the color spaces may be naturally an example and that values of other color spaces may be used. For example, pairs of various device-dependent color spaces and device-independent color spaces may be formed and used, such as using a CMY color space instead of the RGB color space and using an XYZ color space instead of the LAB color space.

Figure 5:
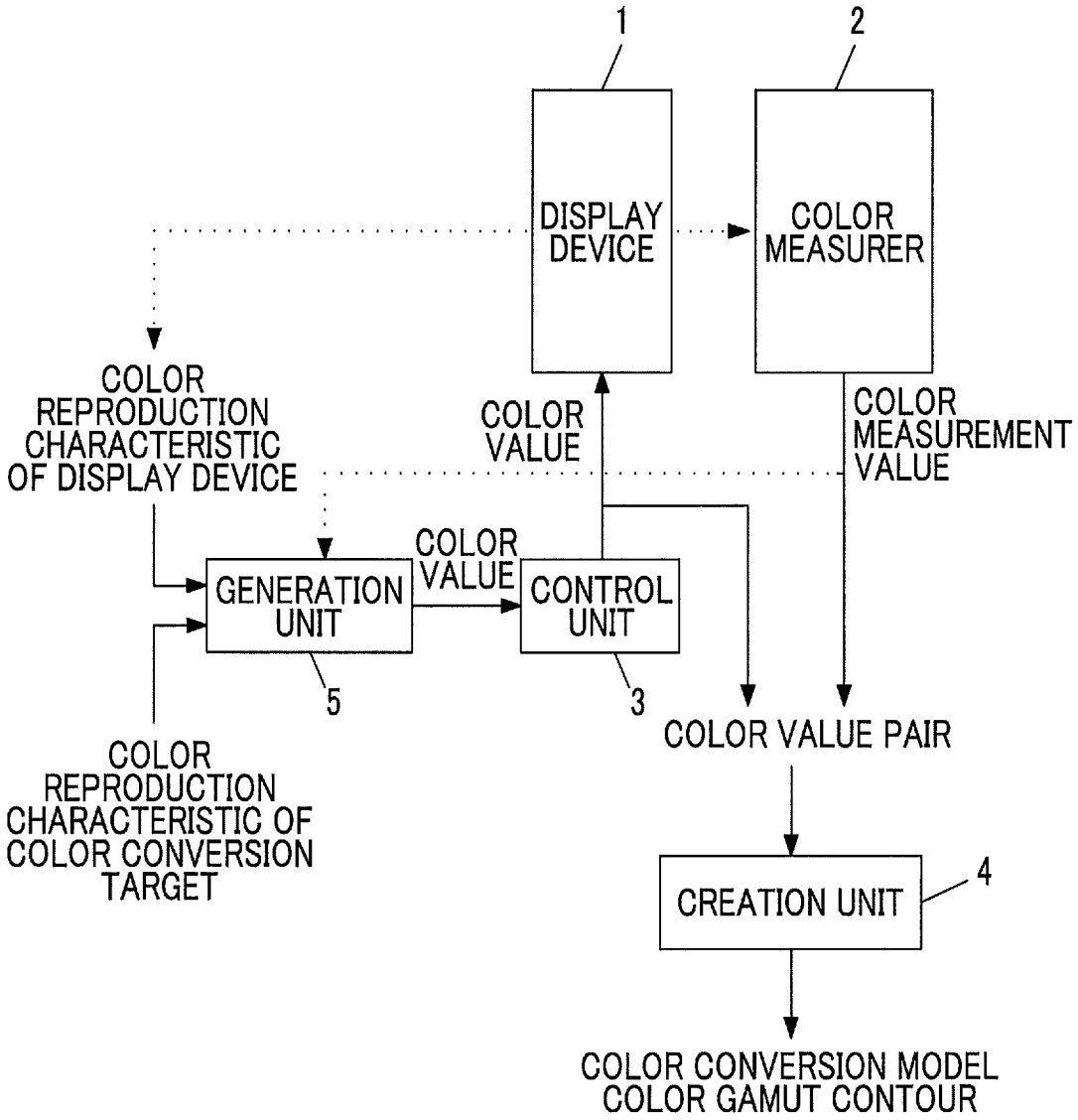
FIG. 5 is a configuration diagram including a second exemplary embodiment of the invention.

FIG. 5 is a configuration diagram including a second exemplary embodiment of the invention. In FIG. 5, 5 denotes a generation unit. The second exemplary embodiment shows an example of, when an image displayed on the display device 1 is output by another output device or colors reproduced in another output device are displayed on the display device 1 or when an image displayed on the display device 1 is converted to an image of a standardized color gamut such as RGB or an image of a standardized color gamut is displayed on the display device 1, generating colors of a color sample corresponding to the output device and acquiring color value pairs. In the following description, it is assumed that a device other than the display device 1, a standard, and the like are referred to as color conversion targets and that color reproduction characteristics corresponding to other output devices and standards are referred to as color reproduction characteristics of color conversion targets.

Color reproductions being performed in different devices leads to different color reproduction characteristics such as a different color gamut which is a range of colors reproduced in the respective devices and different colors reproduced. In addition, the standardized color gamut is different from a color gamut and reproduced colors in a real device, and thus it may be said that the color reproduction characteristics are suitably different from each other. When the devices have different color reproduction characteristics, a color conversion is performed in any one direction or in both directions. In the color conversion, the color conversion model and the color conversion profile which are created by the creation unit 4 are used. However, for example, colors which are reproduced in one device but are not reproduced in other devices and colors which are included in a standardized color gamut but are not reproduced in a device actually performing an output may have a fault such as being converted to colors outside the color gamut after the color conversion, depending on the degree of accuracy at the time of the color conversion.

In order to respond to such a fault, colors becoming important at the time of the color conversion, for example, white, black, R, G, B, C, M, Y, and the like may have accuracy. From this point of view, in the second exemplary embodiment, color reproduction characteristics of other output devices which are set as objects to be output are obtained together with the color reproduction characteristics of the display device 1, or color reproduction characteristics of a standardized color gamut and the like are obtained as target values, and are then compared with the color reproduction characteristics of the display device 1. Various characteristics may be used as the color reproduction characteristics used at the time of the comparison, but, for example, a color gamut, a luminance, a color temperature, and the like may be used. According to the comparison results, a color region is set with respect to important colors, and a color sample may be configured so as to densely include colors of color charts within the color region rather than outside the color region. The control unit 3 gives the values of the colors of the plural color charts constituting the color sample to the display device 1 and causes the display device 1 to display the colors. At this time, the values of the colors which are given to the display device 1 are associated with color measurement values obtained by measuring the colors displayed on the display device 1 using the color measurer 2, and the creation unit 4 acquires the associated values as color value pairs. When the creation unit 4 creates a color conversion model, a color conversion profile, a color gamut contour, and the like using the acquired color value pairs, the creations having a high degree of accuracy are given in the set color region rather than outside the color region. Faults in the mutual color reproduction with the color conversion targets are eliminated by using these creations.

In the second exemplary embodiment, the generation unit is provided. The generation unit 5 compares color reproduction characteristics of the display device 1 with color reproduction characteristics of color conversion targets, sets a color region in accordance with results of the comparison, and generates colors of plural color charts constituting a color sample so that colors within the set color region are densely included as compared with colors outside the color region. The control unit 3 sequentially transmits the values of the colors of the plural color charts which are generated by the generation unit 5 to the display device 1, and causes the display device 1 to display the colors. The creation unit 4 associates the color measurement values obtained by measuring the colors displayed on the display device 1 using the color measurer 2 with the values of the displayed colors to acquire color value pairs, and creates a color conversion model, a color gamut contour, a color conversion profile, and the like.

Figure 6:
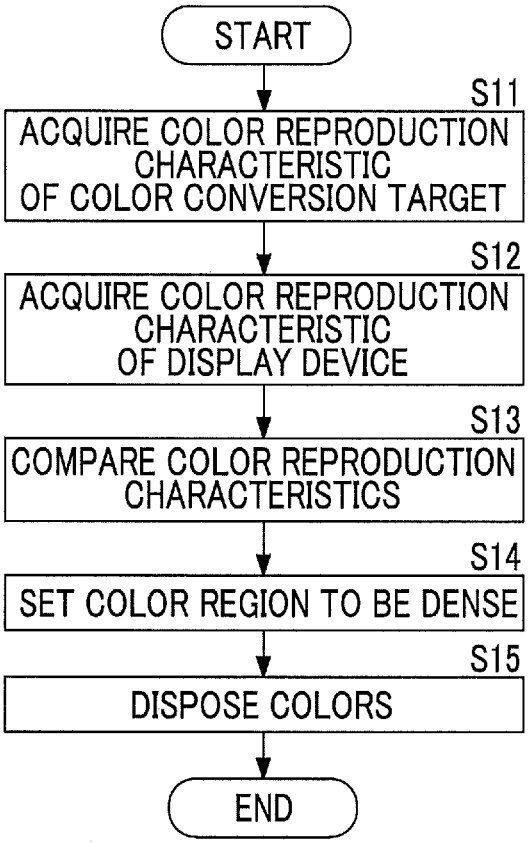
FIG. 6 is a flow chart showing an example of an operation of a generation unit according to the second exemplary embodiment of the invention.

FIG. 6 is a flow chart showing an example of an operation of the generation unit according to the second exemplary embodiment of the invention. In S11, color reproduction characteristics of color conversion targets are acquired. In S12, color reproduction characteristics of the display device 1 are acquired. When the color reproduction characteristics of the display device 1 are acquired, the values of colors representing color reproduction characteristics to be acquired may be transmitted to the control unit 3 and may be displayed on the display device 1, and color measurement values obtained by performing a color measurement using the color measurer 2 may be acquired from the control unit 3.

In S13, the color reproduction characteristics of the display device 1 which are acquired in S12 are compared with the color reproduction characteristics of the color conversion targets which are acquired in S11. In S14, a color region having colors being densely arranged is set in accordance with results of the comparison performed in S13. Then, in S15, values of colors of color charts are generated so as to become dense in the color region set in S14 rather than in other regions, as values of colors of color charts constituting a color sample displayed on the display device 1 by the control unit 3, and are then transmitted to the control unit 3.

The control unit 3 causes the display device 1 to display the values of the colors which are transmitted from the generation unit 5. The creation unit 4 associates the color measurement values obtained by measuring the colors, which are displayed on the display device 1 by the control unit 3, using the color measurer 2 with the values of the colors at the time of a display to acquire color value pairs, and creates a color conversion model, a color gamut contour, a color conversion profile, and the like.

Meanwhile, values of colors of plural color charts, which densely include colors within a color region set in accordance with results of the comparison between the color reproduction characteristics of the display device 1 and color reproduction characteristics of other output devices, as compared with colors outside the color region, may be given in advance to the control unit 3, without providing the generation unit 5. The control unit 3 performs a display control of giving the given values of the colors of the plural color charts to the display device 1 and causing the display device to display the colors.

Figure 7:
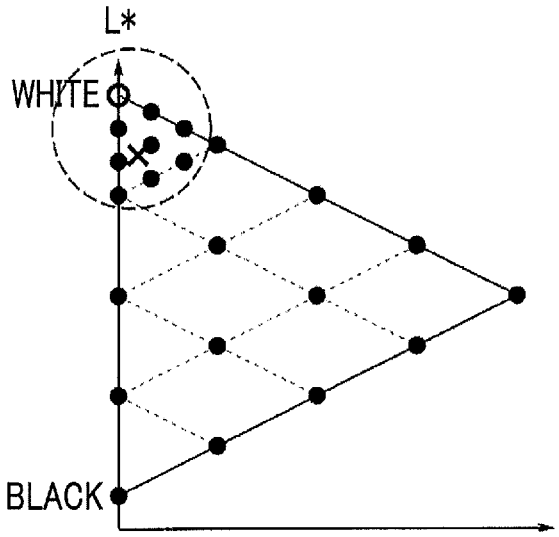
FIG. 7 is a diagram illustrating an example of the generation of colors in a case where a luminance of a white color is used as a color reproduction characteristic in the second exemplary embodiment of the invention.

Hereinafter, some concrete examples will be described. FIG. 7 is a diagram illustrating an example of the generation of colors in a case where a luminance of a white color is used as a color reproduction characteristic in the second exemplary embodiment of the invention. FIG. 7 shows a certain hue cross-section in a LAB color space. In this example, it is assumed that a luminance is used as a color reproduction characteristic, and a color region is set using a white color as an object. A white circle in the drawing indicates a white color in the display device 1, and an x mark indicates a white color in a color conversion target. A white color may be used as a standard of an output device, and requires accuracy as compared with other colors, and thus a white color is used as an object herein.

The generation unit 5 acquires a luminance of the white color of the display device 1 and a luminance of a white color of another output device, compares the luminances, and sets a color region using the white color of the display device 1 as a starting point in accordance with results of the comparison. For example, a difference between both luminances is obtained, and as the difference increases, a wider color region is set. For example, the size of the color region is obtained by a function using the difference as a parameter, or various well-known methods may be adopted as a method of setting a color region, such as a method of providing some divisions regarding the difference and setting a color region, having an area corresponding to the divisions, to which the difference belongs.

In addition, for example, when each of color components of R, G, and B has a value of equal to or greater than 0 and equal to or less than 255, the generation of colors may be performed by calculating a division point of values of the color components as the setting of a color region and by increasing the number of divisions in a region in which all the values of the color components are equal to or greater than the division point and equal to or less than 255 rather than in other regions. Thus, in the set color region, colors of color charts are densely generated rather than outside the color region.

In the example shown in FIG. 7, colors indicated by black circles are densely present in a color region indicated by a circle including the white color of the display device 1 and the white color of another output device, as compared with regions outside the color region. In this manner, the generation unit 5 generates colors of the set color region so as to become dense as compared with colors outside the color region. Values of the generated colors are set as values of colors of plural color charts constituting a color sample and are transmitted to the control unit 3, and are then displayed on the display device 1 under the control of the control unit 3. The colors displayed on the display device 1 are measured by the color measurer 2, color value pairs are acquired by associating color measurement values obtained by performing the color measurement using the color measurer with values of colors which are given to the display device 1, and the creation unit 4 may create a color conversion model, a color conversion profile, and the like using the acquired color value pairs. The degrees of accuracy of the color conversion model, the color conversion profile, and the like which are created are improved in the color region including the white color of another output device, rather than the degree of accuracy outside the color region. Accordingly, when the colors of the color region are made dense rather than colors outside the color region, a color conversion regarding a white color is performed with a high degree of accuracy, as compared with a case where colors are evenly generated.

Meanwhile, a luminance is used as a color reproduction characteristic herein, but it is needless to say that a brightness (L*) may be naturally used. In addition, a color temperature may be used as a color reproduction characteristic. A color region using the white color of the display device 1 as a starting point is set in accordance with a difference between the color temperature of the display device 1 and a color temperature of another output device, and colors of plural color charts constituting a color sample may be generated so that colors within the color region are densely included rather than colors outside the color region.

Figure 8:
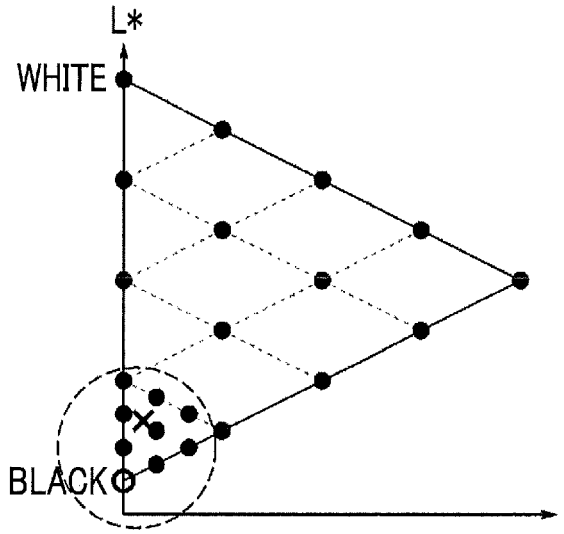
FIG. 8 is a diagram illustrating an example of the generation of colors in a case where a luminance of a black color is used as a color reproduction characteristic in the second exemplary embodiment of the invention.

FIG. 8 is a diagram illustrating an example of the generation of colors in a case where a luminance of a black color is used as a color reproduction characteristic in the second exemplary embodiment of the invention. FIG. 8 shows a certain hue cross-section in a LAB color space. In this example, it is assumed that a luminance is used as a color reproduction characteristic, and a color region is set using a black color as an object. A white circle in the drawing indicates a black color in the display device 1, an x mark indicates a black color in another output device. A black color may be used as a standard of an output device together with a white color, and requires accuracy as compared with other colors, and thus a black color is used as an object herein.

The generation unit 5 acquires a luminance of the black color of the display device 1 and a luminance of the black color of another output device, compares the luminances, and sets a color region using the black color of the display device 1 as a starting point in accordance with results of the comparison. For example, a difference between both luminances is obtained, and as the difference increases, a wider color region is set. For example, the size of the color region is obtained by a function using the difference as a parameter, or various well-known methods may be adopted as a method of setting a color region, such as a method of providing some divisions regarding the difference and setting a color region, having an area corresponding to the divisions, to which the difference belongs.

In addition, for example, when each of color components of R, G, and B has a value of equal to or greater than 0 and equal to or less than 255, the generation of colors may be performed by calculating a division point of values of the color components as the setting of a color region and by increasing the number of divisions in a region in which all the values of the color components are equal to or greater than 0 and equal to or less than the division point, rather than in other regions. Thus, in the set color region, colors of color charts are densely generated rather than outside the color region.

In the example shown in FIG. 8, colors indicated by black circles are densely present in a color region indicated by a circle including the black color of the display device 1 and the black color of another output device, as compared with regions outside the color region. In this manner, the generation unit 5 generates colors of plural color charts constituting a color sample so as to densely include the colors of the set color region, as compared with colors outside the color region. Values of the generated colors of the plural color charts constituting the color sample are transmitted to the control unit 3, and the colors of the color charts are displayed on the display device 1 under the control of the control unit 3. The colors displayed on the display device 1 are measured by the color measurer 2, color value pairs are acquired by associating color measurement values obtained by performing the color measurement using the color measurer with values of colors which are given to the display device 1, and a color conversion model, a color conversion profile, and the like are created by the creation unit 4. The degrees of accuracy of the color conversion model, the color conversion profile, and the like which are created are improved in the color region including the black color of another output device, rather than the degree of accuracy outside the color region. Accordingly, when the colors of the color region are made dense rather than colors outside the color region, color conversion regarding a black color is performed with a high degree of accuracy, as compared with a case where colors are evenly generated.

Meanwhile, a luminance is used as a color reproduction characteristic herein, but it is needless to say that a brightness (L*) may be naturally used.

Figure 9:
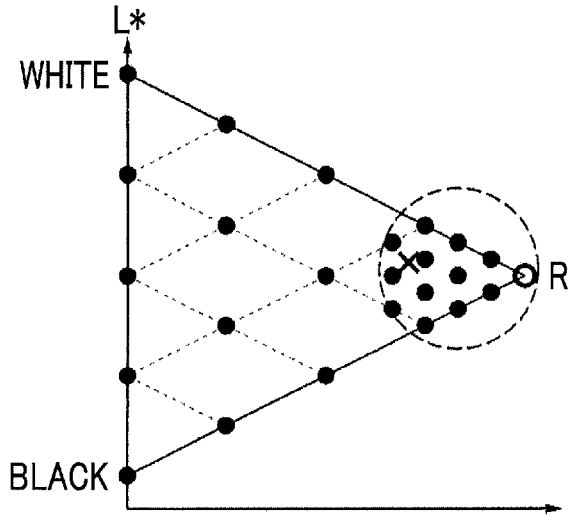
FIG. 9 is a diagram illustrating an example of the generation of colors in a case where a chroma is used as a color reproduction characteristic in the second exemplary embodiment of the invention.

FIG. 9 is a diagram illustrating an example of the generation of colors in a case where a chroma is used as a color reproduction characteristic in the second exemplary embodiment of the invention. FIG. 9 shows the outline of a red hue cross-section in a LAB color space. In this example, a color region is set using important colors of R, G, B, C, M, Y, and the like as objects, other than white and black. Here, R, G, B, C, M, and Y are colors serving as vertexes in both an RGB color space and the LAB color space, and the degree of accuracy of a color conversion performed on these colors affect a color conversion of the entire color gamut. Accordingly, these colors require accuracy as compared with other colors, and thus these colors are used as objects herein.

In the example shown in FIG. 9, as an example, a case where R among the important colors is used as an object is shown. A white circle in the drawing indicates R in the display device 1, and an x mark indicates R in another output device.

The generation unit 5 acquires a chroma of R of the display device 1 and a chroma of R of another output device, compares the chromas, and sets a color region using R of the display device 1 as a starting point in accordance with results of the comparison. For example, a difference between both the chromas is obtained, and as the difference increases, a wider color region is set. For example, the size of the color region is obtained by a function using the difference as a parameter, or various well-known methods may be adopted as a method of setting a color region, such as a method of providing some divisions regarding the difference and setting a color region, having an area corresponding to the divisions, to which the difference belongs.

In addition, for example, when each of color components of R, G, and B has a value of equal to or greater than 0 and equal to or less than 255, the generation of colors may be performed by calculating a division value of the color components as the setting of a color region and by increasing the number of divisions in a region in which the value of the R component is equal to or less than 255 and equal to or greater than (255-division value) and in which both the values of the G and B components are equal to or greater than 0 and equal to or less than the division value, rather than in other regions. Thus, in the set color region, colors of color charts are densely generated rather than outside the color region.

In the example shown in FIG. 9, colors indicated by black circles are densely present in a color region indicated by a circle including R of the display device 1 and R of another output device, as compared with regions outside the color region. In this manner, the generation unit 5 generates colors of color charts constituting a color sample so as to densely include the colors of the set color region, as compared with colors outside the color region. Values of the generated colors of the color charts constituting the color sample are transmitted to the control unit 3, and the colors of the color charts are displayed on the display device 1 under the control of the control unit 3. The colors displayed on the display device 1 are measured by the color measurer 2, color value pairs are acquired by associating color measurement values obtained by performing the color measurement using the color measurer with values of colors which are given to the display device 1, and a color gamut contour, a color conversion model, a color conversion profile, and the like are created by the creation unit 4. The degrees of accuracy of the color gamut contour, the color conversion model, the color conversion profile, and the like which are created are improved in the color region including R of another output device, rather than the degree of accuracy outside the color region. Accordingly, when the colors of the color region are made dense rather than colors outside the color region, a color conversion regarding R is performed with a high degree of accuracy, as compared with a case where colors are evenly generated.

Herein, R is shown as an example, but the color conversion may be performed on at least any one of the colors, inclusive of G, B, C, M, and Y. Naturally, the color conversion may be performed on plural colors or all the important colors. Further, for example, also with respect to a so-called memory color such as a skin color or a sky color, a color region is set in accordance with a difference between a reproduced color of the display device 1 and a reproduced color in a color reproduction target, and colors of color charts constituting a color sample may be generated so as to densely include colors within the color region, rather than colors outside the color region. In addition, a chroma is used as a color reproduction characteristic herein, but it is needless to say that other color reproduction characteristics such as hue and brightness may be used and that a color difference may be used as a difference between color reproduction characteristics.

As stated above, some examples of colors generated by the generation unit 5 have been described. A minimum value and a maximum value of color components in the RGB color space used in each example are not limited to the above-described concrete examples. In the above-described concrete examples, it is assumed that values of colors received in the display device 1 are values of the RGB color space and that color measurement values obtained by performing a color measurement using the color measurer 2 are values of the LAB color space. However, it is needless to say that any of color spaces may be naturally an example and that values of other color spaces may be used. For example, pairs of various device-dependent color spaces and device-independent color spaces may be formed and used, such as using a CMY color space instead of the RGB color space and using an XYZ color space instead of the LAB color space.

In addition, the above-described examples may be appropriately combined. When the generation unit 5 is not provided, a configuration may be provided in which values of colors of color charts constituting the above-described color sample are provided and are used by the control unit 3. Further, the second exemplary embodiment and the first exemplary embodiment described above may be combined to provide a configuration in which colors of color charts constituting a color sample are configured to densely include colors of hues of important colors and colors of ridge lines together with a color region and are displayed on the display device 1 under the control of the control unit 3.

Figure 10:
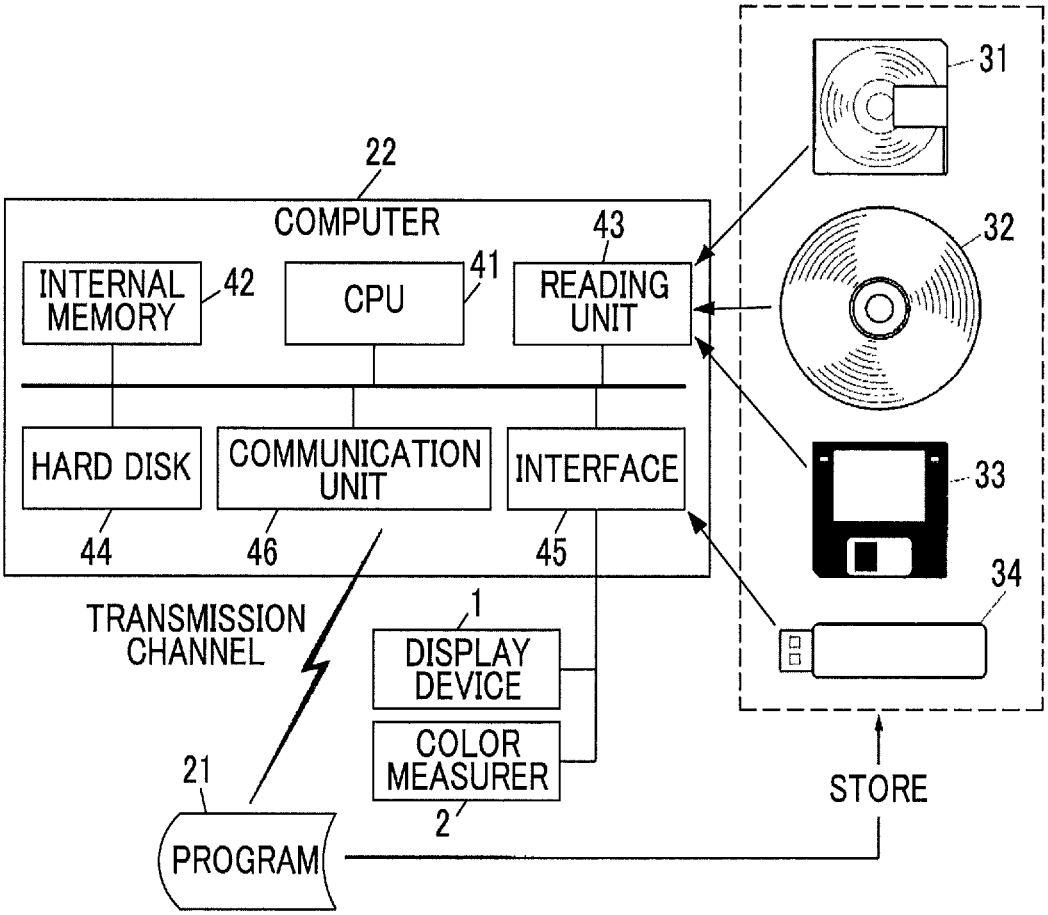
FIG. 10 is a diagram illustrating examples of a computer program in a case where functions described in exemplary embodiments of the invention are realized by the computer program, a storage medium storing the computer program, and a computer.

FIG. 10 is a diagram illustrating an example of a computer program when functions described in the exemplary embodiments of the invention are realized by a computer program, a recording medium having the computer program stored thereon, and a computer. In the drawing, 21 denotes a program, 22 denotes a computer, 31 denotes a magnetooptical disc, 32 denotes an optical disc, 33 denotes a magnetic disk, 34 denotes a memory, 41 denotes a CPU, 42 denotes an internal memory, 43 denotes a reading unit, 44 denotes a hard disk, 45 denotes an interface, and 46 denotes a communication unit.

The function including the control unit 3, the creation unit 4, or the generation unit 5 described above as the exemplary embodiments of the invention may be entirely or partially realized by the program 21 for causing a computer to execute the function. In this case, the program 21, data used by the program, for example, data and the like of values of colors of color charts constituting a color sample given to the display device 1 may be stored in a storage medium read by a computer. The storage medium is a medium that causes change states of magnetic, optical, and electrical energy or the like in response to the contents of a program with respect to the reading unit 43 included in hardware resources of a computer, and transfers the contents of a program to the reading unit 43 in the form of signals corresponding thereto. For example, the recording medium includes the magnetooptical disc 31, the optical disc 32 (including a CD, a DVD and the like), the magnetic disk 33, the memory 34 (including an IC card, a memory card, a flash memory and the like) and the like. Naturally, these storage mediums are not limited to a portable type.

The program 21 is stored in such storage mediums, is read out from a computer, for example, by mounting the storage mediums in the reading unit 43 or the interface 45 of the computer 22, is stored in the internal memory 42 or the hard disk 44 (including a magnetic disk or a silicon disk and the like), and is executed by the CPU 41, and thus the function including the control unit 3, the creation unit 4, or the generation unit 5 described above as the exemplary embodiments of the invention is entirely or partially realized. Alternatively, the function may be realized by transferring the program 21 to the computer 22 through a transmission channel, by receiving the program 21 by the communication unit 46 of the computer 22, by storing the program 21 in the internal memory 42 or the hard disk 44, and by executing the program 21 by the CPU 41.

In addition, various devices may be connected to the computer 22 through the interface 45. For example, the display device 1 and the color measurer 2 may be connected thereto, and a configuration may be given such that values of colors of color charts constituting a color sample are transmitted to the display device 1 to display the colors and such that the colors are measured by the color measurer 2 to acquire color measurement values. Naturally, various other devices may be connected thereto through the interface 45. Meanwhile, the components are not required to operate in one computer. For example, the processing of the control unit, the creation unit 4, or the generation unit 5 may be executed by a different computer. Also in a case where the function of the generation unit 5 is not provided, a data structure of values of colors which are given to the display device 1 may be separately generated and may be stored in advance in the hard disk 44 and the internal memory 42.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A display control device comprising:

a control unit that causes a display unit to display a plurality of color charts constituting a color sample used when obtaining color reproduction characteristics of the display unit, which densely include a color in which all values of two color components are set to be a minimum value or a maximum value of the values of the respective color components, in colors in which a value of one color component out of a plurality of color components in a color space of the display unit is set to be a minimum value or a maximum value of the value of the color component; and a generation unit that compares the color reproduction characteristics of the display unit with color reproduction characteristics of the color conversion target, sets a color region in accordance with results of the comparison, and generates a plurality of colors in a color space of the display unit so as to densely include colors within the color region, as compared with colors outside the color region.

2. A non-transitory computer readable medium storing a display control program causing a computer to execute a function of the display control device according to claim 1.

3. A color value data structure which is constituted by an aggregate of values of the plurality of colors displayed on the display unit when obtaining the color reproduction characteristics of the display unit by the display control device according to claim 1.

4. A display control device comprising:

a display unit to display a plurality of color charts constituting a color sample used when obtaining color reproduction characteristics of the display unit, which more densely include colors included in a hue in which a value of one color component out of a plurality of color components in a color space of the display unit is set to be a maximum value and values of other color components are set to be a minimum value or a hue in which values of two color components are set to be a maximum value and values of other color components are set to be a minimum value, than colors included in other hues; and a generation unit that compares the color reproduction characteristics of the display unit with color reproduction characteristics of the color conversion target, sets a color region in accordance with results of the comparison, and generates a plurality of colors in a color space of the display unit so as to densely include colors within the color region, as compared with colors outside the color region.

5. A display control device comprising:

a control unit that causes a display unit to display a plurality of colors, as colors of a plurality of color charts constituting a color sample used when obtaining color reproduction characteristics of the display unit, in a color space of the display unit which densely includes colors within a color region set in accordance with results of comparison between the color reproduction characteristics of the display unit and color reproduction characteristics of a color conversion target, as compared with colors outside the color region, wherein the control unit causes the display unit to display a plurality of colors that densely include colors within a color region, using a white color as a starting point, which is set in accordance with a difference in a luminance of a white color or a difference in a color temperature between the display unit and the color conversion target as compared with colors outside the color region.

6. The display control device according to claim 5, wherein the control unit causes the display unit to display a plurality of colors that densely include colors within a color region, using a black color as a starting point, which is set in accordance with a difference in a luminance of a black color between the display unit and the color conversion target, as compared with colors outside the color region.

7. The display control device according to claim 5, wherein the control unit causes the display unit to display a plurality of colors that densely include colors within a color region set in accordance with a difference between color reproduction characteristics in at least one color, in a color in which a value of one color component is set to be a maximum value and values of other color components are set to be a minimum value in the display unit and the color conversion target or a color in which values of two color components are set to be a maximum value and values of other color components are set to be a minimum value, as compared with colors outside the color region.

* * * * *